US009931649B2

(12) United States Patent
Buckner

(10) Patent No.: US 9,931,649 B2
(45) Date of Patent: Apr. 3, 2018

(54) ROTATING HIGH PRESSURE AIR AND WATER NOZZLE

(75) Inventor: Don M. Buckner, Okahumpka, FL (US)

(73) Assignee: VAC-TRON EQUIPMENT, LLC, Okahumpka, FL (US)

( * ) Notice: Subject to any disclaimer, the term of this patent is extended or adjusted under 35 U.S.C. 154(b) by 840 days.

(21) Appl. No.: 13/568,342

(22) Filed: Aug. 7, 2012

(65) Prior Publication Data

US 2014/0042245 A1 Feb. 13, 2014

(51) Int. Cl.
*B05B 1/14* (2006.01)
*B05B 3/06* (2006.01)

(52) U.S. Cl.
CPC . *B05B 1/14* (2013.01); *B05B 3/06* (2013.01)

(58) Field of Classification Search
CPC ..... B05B 3/04; B05B 1/14; B05B 3/06
USPC ..... 239/251, 511, 383, 381, 506, 382, 380, 239/463, 505; 4/541.1–541.6
See application file for complete search history.

(56) References Cited

U.S. PATENT DOCUMENTS

| | | | | |
|---|---|---|---|---|
| 1,906,382 | A | 11/1931 | Keys | |
| 2,198,021 | A | 4/1940 | Wood | |
| 2,639,601 | A | 5/1953 | Miller | |
| 3,864,064 | A | 2/1975 | Gannaway | |
| 4,111,278 | A | 9/1978 | Bergman | |
| 4,119,238 | A | 10/1978 | Ja'afar et al. | |
| 4,334,633 | A | 6/1982 | Piegza | |
| 4,744,698 | A | 5/1988 | Dallimer | |
| 4,760,656 | A | 8/1988 | East | |
| 5,092,963 | A | 3/1992 | Barker | |
| 5,191,993 | A | 3/1993 | Wanger | |
| 5,196,654 | A | 3/1993 | Diflora | |
| 5,248,092 | A | 9/1993 | Rankin | |
| 5,291,621 | A * | 3/1994 | Mathis | 4/541.4 |
| 5,500,976 | A | 3/1996 | Rohrbacher | |
| 5,515,625 | A | 5/1996 | Keigley | |
| 5,573,371 | A | 11/1996 | Kieffer | |
| 5,887,667 | A | 3/1999 | Van Zante | |
| 5,996,731 | A | 12/1999 | Czabala | |
| D423,521 | S | 4/2000 | Walter | |
| 6,360,458 | B2 | 3/2002 | Dolister | |
| 6,397,967 | B1 | 6/2002 | McIlwraith | |
| 6,499,934 | B1 | 12/2002 | Kaczmarski | |
| 6,533,064 | B1 | 3/2003 | Kim | |
| 6,550,406 | B2 | 4/2003 | Bass | |
| 6,604,304 | B1 | 8/2003 | Slabach | |
| 6,848,637 | B2 * | 2/2005 | Holtsnider | 239/587.1 |

(Continued)

*Primary Examiner* — Arthur O Hall
*Assistant Examiner* — Chee-Chong Lee
(74) *Attorney, Agent, or Firm* — Matthew G. McKinney, Esq.; Allen, Dyer, Doppelt + Gilchrist, P.A.

(57) ABSTRACT

A rotating high pressure air and water nozzle is disclosed. The nozzle includes a head adapted to rotate, a housing adapted to secure the head therein, and a plurality of passageways disposed through the head. In addition, the nozzle includes a supply port disposed at a first end of each of the passageways, where each supply port has a funnel shape adapted to direct fluid into each passageway to reduce hydraulic losses, and a discharge port disposed at an opposing end of each of the passageways adapted to discharge a jet of fluid. Each discharge port is offset from the respective supply port to cause the head to rotate when fluid flows through the passageways.

13 Claims, 3 Drawing Sheets

(56) References Cited

U.S. PATENT DOCUMENTS

| | | | | |
|---|---|---|---|---|
| 6,860,437 | B1 * | 3/2005 | Amendt et al. | 239/383 |
| 6,988,568 | B2 | 1/2006 | Buckner | |
| 7,484,322 | B2 | 2/2009 | Maybury, Jr. | |
| 7,837,050 | B2 | 11/2010 | Maybury, Jr. | |
| 8,066,140 | B1 | 11/2011 | Young | |
| 8,336,231 | B2 | 12/2012 | Marbury | |
| 2002/0005877 | A1 | 1/2002 | Silverbrook | |
| 2006/0032095 | A1 | 2/2006 | Buckner | |
| 2006/0117612 | A1 | 6/2006 | Maybury, Jr. | |
| 2006/0182591 | A1 | 8/2006 | Hackett | |
| 2009/0126099 | A1 * | 5/2009 | Holtsnider | 4/541.6 |
| 2010/0320204 | A1 | 12/2010 | Maybury, Jr. | |
| 2011/0088289 | A1 | 4/2011 | Maybury, Jr. | |

* cited by examiner

FIG. 3
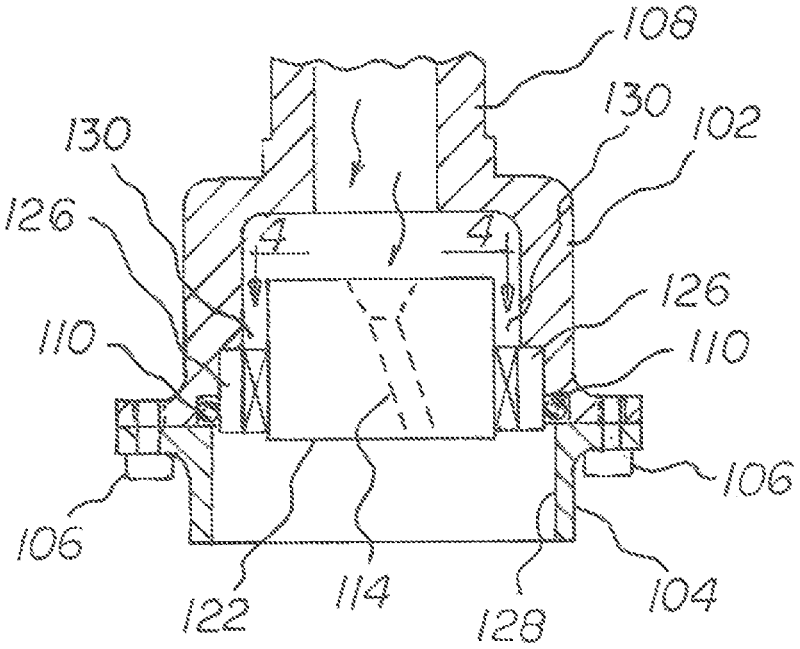
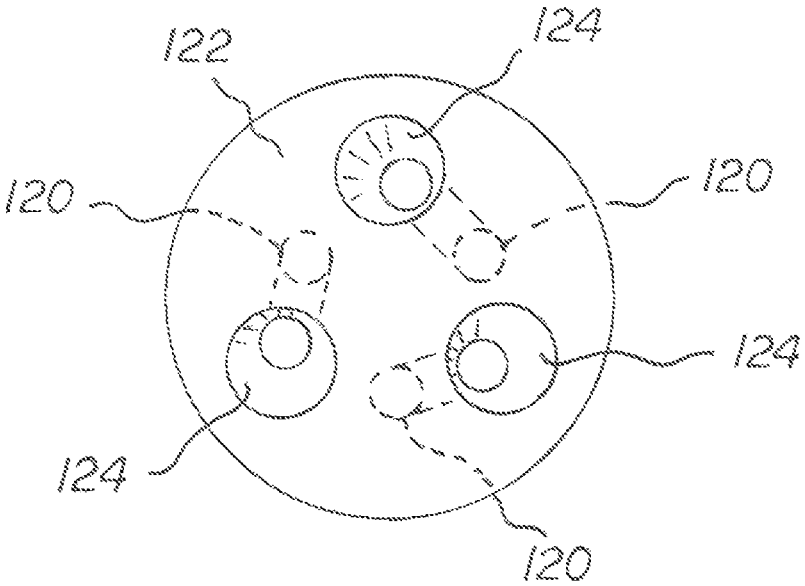
FIG. 4

ROTATING HIGH PRESSURE AIR AND WATER NOZZLE

I. FIELD OF THE INVENTION

The present invention relates generally to a rotating high pressure air and water nozzle.

II. BACKGROUND

High pressure air and water nozzles can be used for many different purposes and applications. For example, there are pressure washers that include a complement of different sized nozzles. Some nozzles cause the water jet to be discharged in a triangular plane such as a fan pattern, while others discharge a thin jet of water, which spirals around rapidly in a cone pattern. Other prior art nozzles use a rotor within a chamber that is susceptible to being easily broken, clogged and is difficult to clean.

Most nozzles attach directly to some type of wand or gun. The pressure washer adds its own power to create higher pressure and velocity. However, these prior art pressure washers typically operate at relatively low flow rates and pressures than required for industrial applications such as part cleaning, hydro-excavation, and boring.

Specialized industrial nozzles that have been developed to handle high flow rates do not generate a dynamic and rotating flow pattern. For example, high pressure nozzles that are used for cleaning industrial parts, deburring industrial parts and the like typically discharge at pressures of several thousand pounds per square inch (psi). A shortcoming of these previously known nozzles, however, is that the nozzles are of a fixed geometry and do not generate a dynamic flow pattern. In addition, when the nozzles are switched from one type of nozzle for one application to a different nozzle, it is necessary to employ cumbersome fluid couplings to ensure fluid tight connections with the nozzle.

III. SUMMARY

The following presents a simplified summary of one or more embodiments in order to provide a basic understanding of some aspects of such embodiments. This summary is not an extensive overview of the one or more embodiments, and is intended to neither identify key or critical elements of the embodiments nor delineate the scope of such embodiments. Its sole purpose is to present some concepts of the described embodiments in a simplified form as a prelude to the more detailed description that is presented later.

In a particular embodiment, a rotating nozzle is disclosed. The nozzle includes a head adapted to rotate, a housing adapted to secure the head therein, a plurality of passageways disposed through the head, a supply port disposed at a first end of each of the passageways. Each supply port may have a funnel shape adapted to direct fluid into each passageway, and a discharge port disposed at an opposing end of each of the passageways adapted to discharge a jet of fluid, where each discharge port is offset from the respective supply port to cause the head to rotate when fluid flows through the passageways. The nozzle also may include a shroud about the head that is adapted to be secured to the housing, where the shroud having a sidewall about its periphery extending beyond the head. A connector may be secured to the housing and adapted to connect a pressurized fluid source to the housing. The pressurized fluid source may be water, air, or any combination thereof. The nozzle is adapted to generate a dynamic spray pattern that emanates directly from the discharge ports. A lower edge of the shroud is adapted to break up soil when the edge is pushed into the soil. In addition, a gasket may be interposed between the housing and shroud to form a watertight connection. The plurality of passageways may be spaced equally from one another on the head. The rotating head further includes a ball bearing that is adapted to mate to a sidewall of the housing using a support ring. A lubricating channel is interposed between a sidewall of the housing and an upper portion of the rotating head.

In another particular embodiment, the nozzle includes a plurality of passageways disposed through a rotating head, a supply port disposed at a first end of each of the passageways, and a discharge port disposed at an opposing end of each of the passageways adapted to discharge a jet of fluid directly to a desired surface, where each discharge port is offset from the respective supply port to cause the head to rotate when fluid flows through the passageways. Each supply port may include a funnel shape, which is adapted to direct fluid into each passageway and to reduce hydraulic losses. The pressurized fluid source is water, air, or any combination thereof. In addition, the nozzle may include an edge protruding from a shroud mounted about the head, where the edge is adapted to dig into the ground and break up the soil. The nozzle is adapted to generate a dynamic spray pattern.

In another particular embodiment, a rotating nozzle is disclosed that includes, a plurality of passageways disposed through a rotating head, where a thickness of the head is approximately equal to or greater to a diameter of the head. A supply port is disposed at a first end of each of the passageways, and a discharge port disposed at an opposing end of each of the passageways. The discharge port is adapted to discharge a jet of fluid directly to a desired surface, where each discharge port is offset from the respective supply port to cause the head to rotate when fluid flows through the passageways. Further, each supply port may include a funnel shape adapted to direct fluid into each passageway. The nozzle further includes an edge protruding from a shroud mounted about the head.

To the accomplishment of the foregoing and related ends, one or more embodiments comprise the features hereinafter fully described and particularly pointed out in the claims. The following description and the annexed drawings set forth in detail certain illustrative aspects and are indicative of but a few of the various ways in which the principles of the embodiments may be employed. Other advantages and novel features will become apparent from the following detailed description when considered in conjunction with the drawings and the disclosed embodiments are intended to include all such aspects and their equivalents.

IV. BRIEF DESCRIPTION OF THE DRAWINGS

FIG. 3 is a cross sectional view of the nozzle shown in FIGS. 1 and 2;

FIG. 4 is a top view of a rotating head of the nozzle; and

V. DETAILED DESCRIPTION

The word "exemplary" is used herein to mean "serving as an example, instance, or illustration." Any embodiment or design described herein as "exemplary" is not necessarily to be construed as preferred or advantageous over other embodiments or designs.

Figure 1:
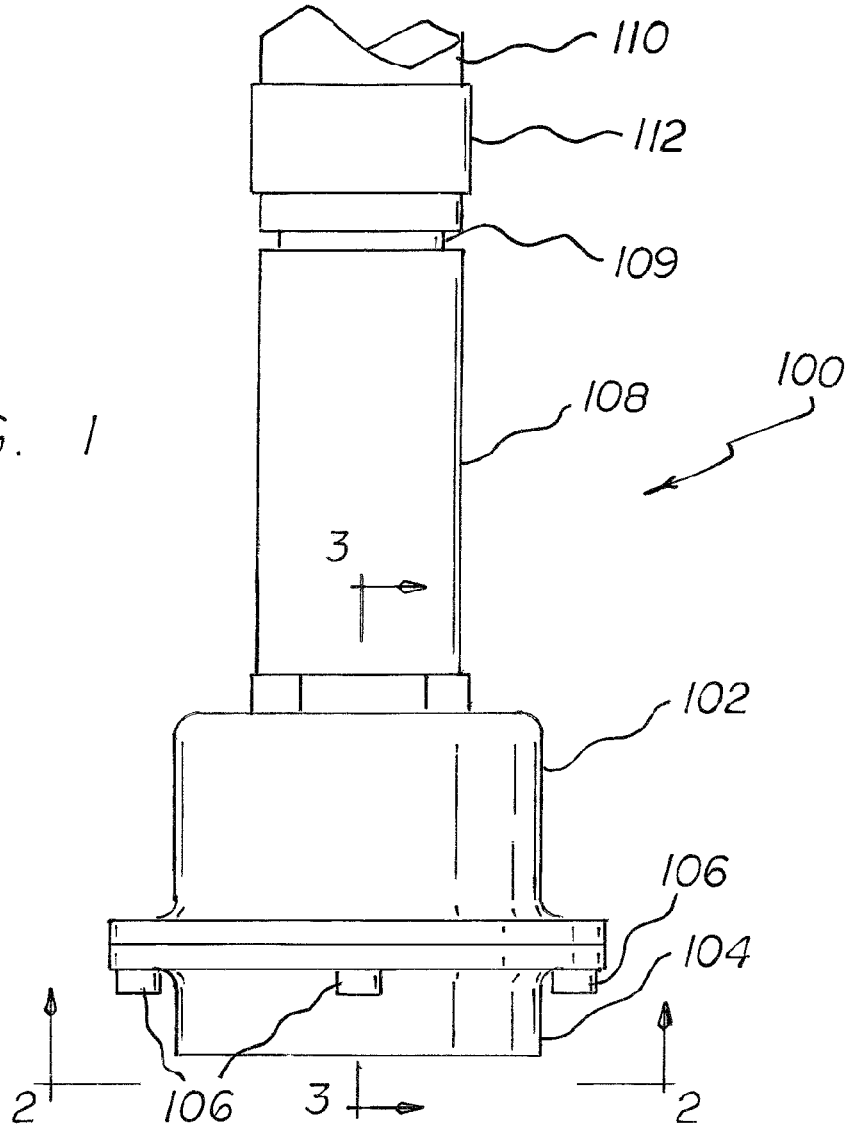
FIG. 1 is an elevation view of a particular embodiment of a rotating high pressure air and water nozzle.

Referring to FIG. 1, a particular illustrative embodiment of a rotating high pressure air and water nozzle is disclosed. The nozzle 100 may be used with pressures of several thousand pounds per square inch and high flow rates (e.g., 10+ gallons per minute). The nozzle 100 includes a housing 102 that is secured to a shroud 104. Bolts 106 or other fastening means are used to secure the housing 102 to the shroud 104. A connector 108 is adapted to be secured to the housing 102, where the connector 108 is adapted to connect a pressurized fluid source 110 to the housing 102. In a particular embodiment, the connector 108 includes a step down portion 109 to a smaller diameter that allows a fluid source 110 such as a hose to slide over and be secured with a clamp 112, or other similar fastening means to the housing 102. Accordingly, the nozzle 100 can be quickly disconnected from the pressurized fluid source 110 as needed. A quick release fitting may also be used.

Figure 2:
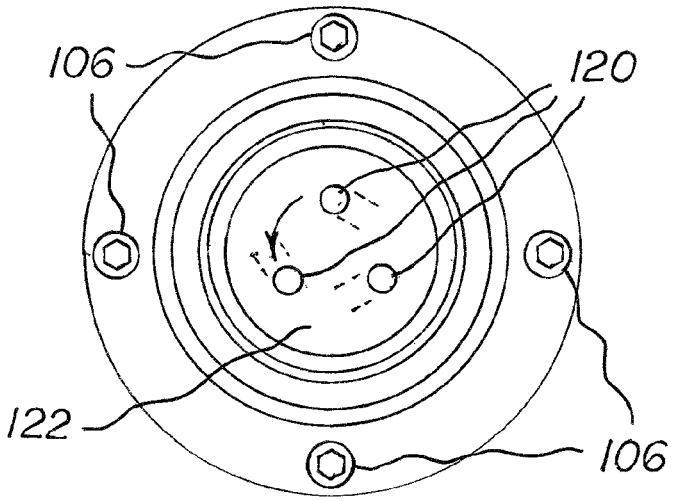
FIG. 2 is a bottom view of the nozzle shown in FIG. 1.

Looking inside the shroud 104 from the bottom as shown in FIG. 2, a plurality of passageways 114 are disposed through a rotating head 122. The rotating head is driven by the torque created by high pressure fluid being forced through the passageways 114 and discharged. The rotating head 122 is secured and seated within the housing 102 using a ball bearing or other roller bearing. A discharge port 120 is disposed at an opposing end of each of the passageways 114 and is adapted to discharge a jet of fluid. Each discharge port 114 is offset from the respective supply port to cause the head 122 to rotate when fluid flows through the passageways 114. Bolts 106 are evenly spaced and secure the shroud 104 to the housing 102. In FIGS. 1-5, three passageways 114 and respective discharge and supply ports are illustrated as an exemplary nozzle 100. However, a different head 122 with smaller or larger diameter ports or different number of ports and passageways, for example, can be swapped out of the nozzle 100 by removing bolts 106 to separate the shroud 104 from the housing 102 to access the head 122.

A cross section of a particular embodiment of the nozzle 100 is shown in FIG. 3. As explained above, a housing 102 is secured to a shroud 104 using bolts 106 or other fastening means. The rotating head 122 is seated within the housing 102. A supply port 120 is disposed at a first end of each of the passageways 114, where each supply port 120 having a funnel shape adapted to direct fluid into each passageway 114. The shroud 104 includes a sidewall about its periphery extending beyond the head 122. The connector 108 is adapted to be secured to the housing 102, where the connector 108 is adapted to connect a pressurized fluid source to the housing 102. The pressurized fluid source is most often supplied through a flexible house in communication with a pump (not shown) to the nozzle 100. The pressurized fluid source may include water, air, media (e.g., sand), or any combination thereof. The nozzle is adapted to generate a dynamic spray pattern that emanates directly from the discharge ports 120. The discharge ports 120 are adapted to discharge a jet of fluid directly to a desired surface while rotating.

The lower edge of the shroud 104 is adapted to break up soil when the edge is pushed into the soil. Accordingly, the shroud 104 and high pressure fluid may be used together to break up harder ground while excavating. As the shroud 104 is pushed into the ground, the shroud 104 protects the rotating head 122 and allows the rotating head 122 to continue to discharge fluid while rotating. The shroud 104 also serves to protect the user from dangerous overspray from the industrial high pressures and flow rates used with the nozzle 100. A gasket 110 is interposed between the housing 102 and shroud 104 to form a watertight connection.

As shown in FIG. 4, the supply ports 124 are funnel shaped to reduce hydraulic losses, and in a particular embodiment, the plurality of passageways 114 are spaced equally from one another on the head 122. The connector 108 may be a rigid tube secured to an upper portion of the housing 102 and adapted to connect the nozzle 100 to the pressurized fluid source 110. The rotating head 122 may include a solid center core for the ports 120, 124 and passageways 114, and a support ring 126 that is adapted to mate to a sidewall of the housing 102.

The rotating head 122 may include a ball bearing or other similar bearing means well known in the art. For example, the head 122 may have a concentric inner race relative to an outer race on the support ring 126. The outer race remains stationary and the inner race is attached to the rotating head 122. As one of the bearing races rotates, the balls between the races rotate as well to reduce friction. The purpose of the ball bearing (or other rolling bearing) is to reduce rotational friction and support radial and axial loads. For the bearing to operate properly, it needs to be lubricated. Accordingly, an annular lubricating channel 130 is interposed between a sidewall of the housing 102 and an upper portion of the rotating head 122, allowing fluid to work its way into the bearing to keep the bearing lubricated. In addition, the bearing may be lubricated with grease or oil.

A thickness of the head 122 is approximately equal to or greater to a diameter of the head 122, where a length of each passageway 114 through the head 122 is proportionate to a torque applied to the head 122 by the pressurized fluid flowing through each passageway 114. Accordingly, the thicker the rotating head 122, the longer the passageways 114 and increase in torque.

The nozzle 100 may be used in conjunction with a suction hose well known in the art. The suction hose is in communication with a pump that provides suction to the hose to remove soil, water, and other materials that are being excavated from a site. For example, the nozzle 100 may be secured to an inside or outside sidewall of the suction hose. In an alternative embodiment, the nozzle 100 may be secured to the distal end of a pressure washer wand, where the pressure washer wand is removably secured to an exterior surface of the suction hose. The edge of the shroud 104 may be used to tap the ground to break or pierce hard pieces of soil.

Figure 5:
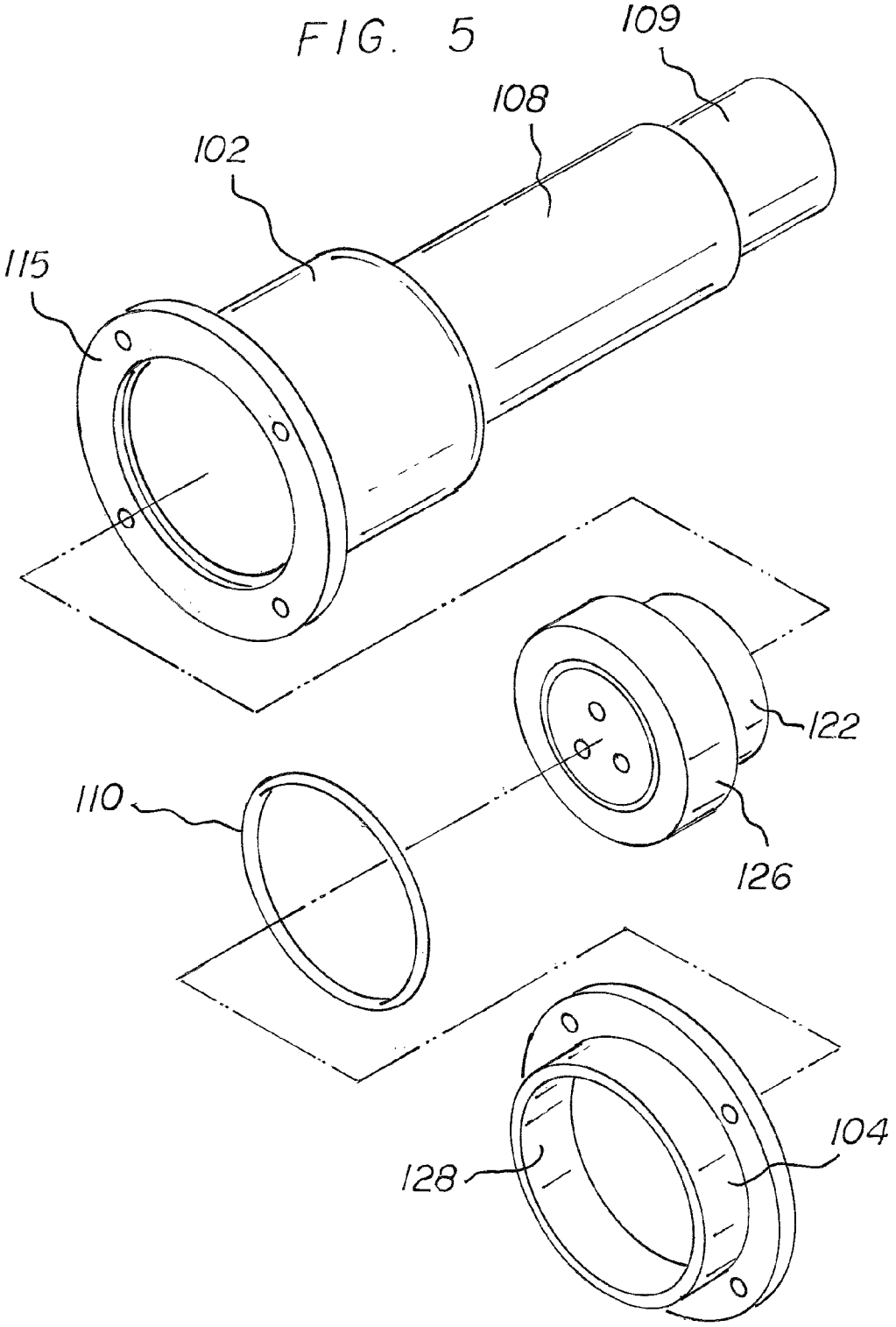
FIG. 5 is a perspective exploded view of a particular embodiment of the rotating high pressure air and water nozzle.

Referring now to FIG. 5, the housing 102 has a diameter larger than the rotating head 122 in this particular embodiment. The support ring 126 is adapted to be secured to the head 122 by a ball bearing, where the support ring 126 fits adjacent to the inside of the housing 102. To assemble the nozzle 100, the rotating head 122 and attached support ring 126 are slipped partially into the housing 102. A boss on the inside of the housing 102 seats the support ring 126. An O-ring 110 or other type of gasket is placed around the support ring 126 and the shroud 128 is secured to the housing 102 using a flange 115 on the housing 102.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

The Abstract of the Disclosure is provided to comply with 37 C.F.R. § 1.52(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

What is claimed is:

1. A nozzle comprising:

a head having a circular periphery;

a housing having the head secured therein;

a circular support ring adjoining an inside wall of the housing and secured to the circular periphery of the head in order for the head to rotate therein;

a plurality of passageways disposed through the head;

a supply port disposed at a first end of each of the passageways; and a discharge port disposed at an opposing end of each of the passageways, wherein each discharge port is offset from the respective supply port and configured to cause the head to rotate when fluid flows through the passageways.

2. The nozzle of claim 1, the nozzle further comprising a shroud about the head secured to the housing, wherein the shroud having a sidewall about its periphery extending beyond the head.

3. The nozzle of claim 2, the nozzle further comprising a connector secured to the housing to connect a pressurized fluid source to the housing.

4. The nozzle of claim 3, wherein the pressurized fluid source is water, air, or any combination thereof.

5. The nozzle of claim 4, wherein the discharge ports are configured to generate a dynamic spray pattern.

6. The nozzle of claim 5, the shroud comprises a lower edge configured to break up soil when the lower edge is pushed into the soil.

7. The nozzle of claim 6, further comprising a gasket interposed between the housing and shroud to form a watertight connection.

8. The nozzle of claim 7, wherein the plurality of passageways are spaced equally from one another on the head.

9. The nozzle of claim 8, wherein each supply port having a funnel shape.

10. The nozzle of claim 1, wherein an annular lubricating channel is interposed between the inside wall of the housing and an upper portion of the head and configured to be in fluid communication with the fluid.

11. The nozzle of claim 1, wherein the plurality of passageways are configured to withstand a fluid at a pressure of at least 1,000 pounds per square inch and a flow of at least 10 gallons per minute.

12. The nozzle of claim 1, wherein the head having a solid center core.

13. A nozzle comprising:

a head comprising a right circular cylinder;

an annular support ring;

a rolling bearing securing the annular support ring around a periphery of the head;

a plurality of passageways disposed through the head;

a supply port disposed at a first end of each of the passageways; and a discharge port disposed at an opposing end of each of the passageways, wherein each discharge port is offset from the respective supply port and configured to cause the head to rotate when fluid flows through the plurality of passageways.

* * * * *